United States Patent [19]

Gaisch et al.

[11] Patent Number: 4,537,204

[45] Date of Patent: Aug. 27, 1985

[54] METHOD OF TOBACCO TREATMENT TO PRODUCE FLAVORS

[75] Inventors: Helmut Gaisch, Cormondreche, Switzerland; Patrick D. L. Ghiste, Montbažin-Meze, France; Dieter Schulthess, Neuchatel, Switzerland

[73] Assignee: Fabriques de Tabac Reunies S.A., Neuchatel, Switzerland

[21] Appl. No.: 456,868

[22] Filed: Jan. 10, 1983

[30] Foreign Application Priority Data

Jan. 9, 1982 [EP] European Pat. Off. ..... 82100112

[51] Int. Cl.[3] ..... A24B 3/12; A24B 15/20

[52] U.S. Cl. ..... 131/274; 131/275; 131/276; 131/297; 131/308

[58] Field of Search ..... 131/274, 275, 276, 297, 131/298, 308, 309, 310

[56] References Cited

U.S. PATENT DOCUMENTS

| | | | |
|---|---|---|---|
| 2,103,495 | 12/1937 | Ruckdeschel | 99/27 |
| 2,564,763 | 8/1951 | Kass | 99/90 |
| 3,060,031 | 10/1962 | Moriarty et al. | 99/90 |
| 3,106,209 | 10/1963 | Torigian | 131/276 |
| 3,132,651 | 5/1964 | Kiefer | 131/276 |
| 3,256,888 | 6/1966 | de la Burde | 131/276 |
| 3,256,889 | 6/1966 | de la Burde | 131/276 |
| 3,478,015 | 11/1969 | Onishi et al. | 260/211 |
| 3,722,516 | 3/1973 | Suwa et al. | 131/276 |
| 3,920,026 | 11/1975 | Warfield et al. | 131/276 |
| 4,135,521 | 1/1979 | Malan et al. | 131/290 |
| 4,306,577 | 12/1981 | Wu et al. | 131/276 |
| 4,308,877 | 1/1982 | Mattina | 131/297 |
| 4,407,307 | 10/1983 | Gaisch et al. | 131/308 |

FOREIGN PATENT DOCUMENTS

| | | |
|---|---|---|
| 24152 | 8/1980 | European Pat. Off. . |
| 2389341 | 5/1978 | France . |
| 64076 | 4/1972 | Luxembourg . |
| 1515962 | 6/1976 | United Kingdom . |

OTHER PUBLICATIONS

P. Koehler et al., "Formation of Pyrazine Compounds in Sugar-Amino Acid Model Systems", *J. Agr. Food Chem.*, 17, No. 2, pp. 393-396.

P. Koehler et al., "Factors Affecting the Formation of Pyrazine Compounds in Sugar-Amine Reactions", *J. Agr. Food Chem.*, 18, No. 5, pp. 895-898 (1970).

*Primary Examiner*—V. Millin

*Attorney, Agent, or Firm*—Arthur I. Palmer, Jr.; James F. Haley, Jr.; Margaret A. Pierri

[57] ABSTRACT

A method for producing tobacco flavors which comprises the steps of hydrolytically degrading into amino acids the proteins of biomass produced by the assimilation of low molecular weight nitrogen compounds from an aqueous tobacco extract, isolating the amino acid mixture and converting that mixture into flavors by the use of reducing sugars and heat. The flavors of this invention may be added to smoking products to improve their aroma and taste.

16 Claims, No Drawings

METHOD OF TOBACCO TREATMENT TO PRODUCE FLAVORS

TECHNICAL FIELD OF INVENTION

This invention relates to a method for treating tobacco to produce flavors comprising the steps of hydrolytically degrading into amino acids the proteins of biomass produced by the assimilation of low-molecular weight nitrogen compounds from an aqueous tobacco extract, isolating the amino acid mixture, converting that mixture into flavors by the use of reducing sugars and heat, and contacting smoking products with those flavors. More particularly, the invention relates to the smoking products produced by contacting tobacco with these flavors.

BACKGROUND ART

It is generally recognized that reduced delivery of oxides of nitrogen in the smoke of tobacco products is desirable. Therefore, a number of methods have been developed to reduce the levels of nitrogen oxide precursors, such as nitrates and nitrites, in smoking products. Among these are microbial-based methods where microbial metabolism of nitrogen-containing compounds is employed to remove them from the tobacco.

It is also generally recognized that the use of flavors, i.e., aroma-producing substances, which generate a taste typical to tobacco when the tobacco is being smoked, are highly desirable in smoking products. Such flavors can be obtained, for example, from amino acids which are subjected to the so-called Maillard reaction. The quality of the flavors obtained in this way depends upon the amino acids used. Once produced these flavors are applied to smoking products in appropriate quantities. Most preferably, flavors that originate in tobacco components themselves are employed to provide smoking products with a pleasant aroma and taste.

DISCLOSURE OF THE INVENTION

This invention combines the desirability of removing nitrates and other nitrogen-containing compounds from tobacco and of adding flavors which are generated from tobacco components to smoking products to improve their taste and aroma. It is characterized by a method that comprises the steps of hydrolytically degrading into amino acids the proteins of biomass produced by the assimilation of low-molecular weight nitrogen compounds from an aqueous tobacco extract, with tryptophan being destroyed in the process to less than 0.01 percent by weight, isolating the amino acid mixture and converting that mixture into flavors by the use of reducing sugars and heat.

The biomass useful in this process is most preferably produced by a method comprising the following steps extracting soluble tobacco components with water, removing the low-molecular weight nitrogen compounds from the aqueous tobacco extract via a metabolic assimilation process using appropriate microorganisms and removing the biomass from the tobacco solution.

As will be appreciated from the disclosure to follow, it has unexpectedly been discovered that the methods of this invention allow excellent flavoring and do not require any essential additional substrates, other than the relatively inexpensive sugar, because the biomass from which the amino acid flavors are generated is produced in sufficient quantities during denitration of the tobacco.

DETAILED DESCRIPTION OF THE INVENTION

The present invention provides novel and inexpensive methods to remove nitrates and other nitrogen-containing compounds from tobacco and to employ the biomass produced in that removal process to produce flavors that on application to tobacco provide a pleasing taste and aroma to the smoking product.

The flavors produced in this invention may be used to improve the taste of any kind of tobacco, particularly tobacco of poor quality. These flavors, however, are preferably applied to tobacco which has suffered the loss of taste components as a natural consequence of the denitration described above, for which the method of flavoring can provide a compensation. Flavoring according to the invention is also particularly useful for the treatment of reconstituted tobacco after the loss of taste due to the reconstitution process.

In one preferred embodiment of this invention microorganisms which can obtain their nitrogen requirements from nitrate or nitrite degradation are added to the extracted tobacco solution to assimilate the nitrate or nitrites. During assimilation, the solution is enriched by the use of a carbon source to a concentration of $16.5 \pm 10$ assimilative carbon atoms per nitrate molecule and by necessary nutrients, other than nitrogen, while being aerated at a rate of 0.5 to 2.5 $l \times l^{-1} \times min^{-1}$ and maintained at pH values between 3.5 and 6 and at temperatures between 25° C. and 37° C. Assimilation in such a manner is usually maintained until the nitrate content of the tobacco extract is reduced to a maximum of 10 ppm. Reduction of the nitrates necessarily implies a corresponding reduction of the nitrites and ammonium salts.

Aeration is preferably performed at a rate of 1.4 to 1.6 $l \times l^{-1} \times min^{-1}$, the pH value is preferably maintained at $5.5 \pm 0.3$ and the temperature is preferably maintained at 30° C. $\pm$ 3° C. A variety of microorganisms which are capable of the assimilatory metabolism of nitrates are suitable for use in the present invention. Preferably, however, yeasts from the Candida family are employed. Most preferably, a Candida yeast selected from the group consisting of Candida utilis NCYC 707, Candida berthetii CBS 5452, Candida utilis NCYC 321, and Candida utilis DSM 70167 is used.

Because it is also desirable to reduce the levels of water-insoluble nitrogen-containing compounds, such as proteins or protein components, in tobacco, it is often useful to solubilize such compounds prior to or contemporaneously with the water extraction of the tobacco. In a preferred embodiment of this invention, therefore, the insoluble protein components and sub-components of the tobacco are first decomposed by fermentation or enzyme treatment into soluble protein fragments and then these soluble protein fragments together with the other soluble tobacco components are extracted by water and subjected to metabolic assimilation, as described above, from the extracted solution. Through this process, the nitrogen components of the proteins are subjected to the same assimilation as the soluble nitrates and the like. The enzymes which are suitable for enzyme treatment or fermentation are specified in Table 1.

After assimilation of the nitrates from the extracted tobacco solution, the biomass is separated by conventional means from the solution. The proteins in this biomass may then be hydrolyzed directly or they may first be separated from the biomass for hydrolysis in a separate step.

Preferably, hydrolysis is performed under the conditions specified hereafter: at a temperature of 50°–130° C., preferably 90° C.; for a duration of 2–300 hours, preferably 110 hours; with a yeast solids content of 5–50 percent (percentage by weight), preferably 20 percent; with an acid concentration of 0.5–45 N (normal), preferably 6 N in the case of hydrochloric acid and and 45 N in the case of phosphoric acid; at a pressure of 1–3 atmospheres, preferably 1 atmosphere, and under continuous stirring.

Optionally, solid matter which results after hydrolysis may be removed before employing the solution of amino acids to produce the desired flavors. This is, however, not mandatory. The solid matter—the insoluble cell residues of the biomass—may alternatively be left in the mixture and also be subjected to the Maillard reaction. In such a case it is preferable to evaporate to dryness the solution which results after the hydrolysis in order to obtain the necessary concentration for the Maillard reaction. It is most preferred in this invention to use a process wherein the amino acids are isolated from the hydrolyzed solution prior to the Maillard reaction. This is appropriately done through isolation of the amino acid mixture contained in the solution by means of chromatographic adsorption and through subsequent evaporation to dryness.

The Maillard reaction is appropriate performed under conditions as specified hereafter: at a pH value of 3–12, preferably 6–7; with the pH value being adjusted by the use of ammonium hydroxide or potassium hydroxide or phosphoric acid; with a duration of the treatment of 1–200 hours, preferably 70–140 hours; at a temperature of 20°–180° C., preferably 90°–140° C.; with a molar ratio of the amino acids to the reducing sugar added between 4:1 and 1:4, preferably between 1:1 and 2:1; in aqueous solution with a solids content of 20–70 percent by weight, preferably 45–55 percent by weight; at a pressure of 1–5 atmospheres, preferably 1 atmosphere, and under continuous stirring.

It is possible to use the reaction mixture resulting from the Maillard reaction directly as a flavor and to apply it to the tobacco, e.g., by spraying or other conventional tobacco contacting means. For example, the flavor obtained may be sprayed onto tobacco in quantities of 0.05 to 0.8 milliliters per gram of tobacco material. It is however, also possible to extract the components which are essential to the desired flavor from the reaction mixture, e.g., with dichloromethane or isobutyl alcohol. Alternatively, the flavors may be isolated from the product of the Maillard reaction by the use of fractionating distillation.

The following examples are illustrative of the invention.

EXAMPLE 1

(a) Deproteinization and Denitration of the Tobacco 3.75 g (grams) of the enzyme protease EC 2.4.24.4 with an enzyme activity of 1.0 enzyme unit per mg (milligram) were dissolved in 10 l (liters) of water. One enzyme unit is the activity which hydrolyzes casein at a pH of 7.5 and at 37° C. (degrees Celsius) such as to cause the quantity of 1 micromole of tyrosine to be released per minute. To this 10 l of enzyme solution was added 1 kg (kilogram) of tobacco mixture (American Blend), in the form of so-called strips (leaves without ribs), to form a sludge. The sludge was allowed to stand for 6 hours at 37° C., with occasional stirring. The aqueous phase was then separated from the strips, and the strips were washed twice in 2.5 l of water of 80° C. each time and squeezed afterwards. The aqueous phase, the washing water, and the liquid obtained by squeezing the strips were then mixed. A total of 12 l of solution was obtained by this process.

The pre-treated tobacco, i.e., the squeezed strips, was dried in flowing hot air to a residual moisture content of 18% (percent) and stored. The tobacco mixture to be treated, the solution, and the pre-treated tobacco were analyzed. The results of the analysis are set forth in Table 3. As can be seen from Table 3, 58 percent by dry weight of the proteins contained in the tobacco mixture which was employed were degraded, with the degradation products being transferred into the solution.

(b) Metabolic Assimilation

To the 12 l of solution described above were added the following substances:

| | |
|---|---|
| Glucose<br>(40 g per 1.086 g $NO_3$—N + $NH_2$/$NH_3$—N) | 506 g |
| $KH_2PO_4$ (potassium hydrophosphate)<br>(0.2% per quantity being extracted) | 24 g |

The solution was sterilized in an autoclave at 105° C. and at superatmospheric pressure. The pressure was then released and the solution was cooled to 30° C. and transferred into a 20 l fermenter. The solution at a temperature of 30° C. was then inoculated with 600 ml (milliliters) of a culture of Candida utilis NCYC 707, the yeast being in its exponential growth phase. The inoculated solution was left in the fermenter for 8 hours under aeration and continuous stirring. The pH value was stabilized first with KOH (potassium hydroxide) and later with citric acid to pH 5.5. Proteins, amino acids, nitrates, and nitrites were degraded by metabolic assimilation during this fermentation. After 8 hours, the biomass was centrifuged off. 2.25 l of biomass with a solids content of 16% corresponding to 360 g of water-free biomass were obtained.

The supernatant resulting from centrifugation—the so-called residue solution—contained the tobacco alkaloids in substantially the same concentration as before, but only remnants of the soluble nitrogen-containing compounds remained. The total volume of 9.75 l of the residue solution was evaporated to 2 l and readded to the pretreated tobacco by spraying. This tobacco was then dried. Table 2 specifies the analyses of cigarettes which were made using such tobacco.

(c) Recovery of Amino Acids

The biomass obtaind above was dried. 1 kg of the dried biomass was mixed with 3.5 l HCl (6 N) and refluxed for 140 hours. The resulting hydrolysate was centrifuged at 15,000×g for 20 minutes, and the supernatant liquid was evaporated to one third of its original volume. The distillate contained HCl and could be used for additional hydrolytic processes.

The residue of the hydrolysis and distillation was mixed with an identical volume of an ion exchanger (300 amberlite IR-120, Fluka), 0.6 l HCl (0.1 N) added, and the mixture shaken for 2 hours at room temperature. The ion exchanger was then separated from the liquid phase by filtration and washed with 250 ml of deionized water.

The ion exchanger was then mixed with 0.8 l $NH_4OH$ (7 N) and shaken for 2 hours at room temperature. The ion exchanger was again separated by filtration and washed with 150 ml of deionized water. The amino acids were contained in the filtrate which was evaporated to dryness. By this process, 300 g of a mixture of amino acids could be recovered from 1 kg of biomass. The composition of this mixture is shown in Table 4.

(d) Recovery of the Flavor 100 g of the amino acid mixture prepared as above were mixed with 55 g glucose and 188 g of deionized water. The pH was adjusted to 9.5 by the use of a 25% ammonium hydroxide solution. The reaction mixture was then refluxed for a duration of 70 hours. The resulting brown product solution was filtered and the filtrate was sprayed onto reconstituted tobacco in quantities of 20%.

EXAMPLE 2

(a) Denitration of the Tobacco 1 kg of a tobacco mixture consisting of Burley ribs were washed with 14 l of water for 1 hour at 80° C. and squeezed afterwards. The washing water obtained by squeezing resulted in a total of 12 l of solution and contained 1140 ppm of nitrate nitrogen.

(b) Metabolic Assimilation

Same as Example 1.

(c) Recovery of Amino Acids

Same as Example 1.

(d) Recovery of the Flavor

Same as Example 1.

EXAMPLE 3

(a) Denitration of the Tobacco

Same as Example 2.

(b) Metabolic Assimilation

Same as Example 2.

(c) Recovery of Amino Acids

The biomass obtained above was dried. 1 kg of the biomass was mixed with 5 l $H_3PO_4$ (85%) and refluxed for 140 hours. The resulting hydrolysate was filtered through a fritted glass filter and the filtrate mixed with 300 g of amberlite IR-120 and 0.6 l of HCl (0.1 N). This mixture was shaken for 10 hours at room temperature. Afterwards the amberlite was separated from the liquid phase by filtration and washed in 360 ml of deionized water.

The ion exchanger was then mixed with 0.8 l $NH_4OH$ (7 N) and shaken for 2 hours at room temperature. The ion exchanger was again separated by filtration and washed with 150 ml of deionized water. The amino acids contained in the filtrate were evaporated to dryness. By this process, 320 g of a mixture of amino acids were recovered from 1 kg of biomass. The composition of this mixture is shown in Table 4.

(d) Recovery of the Flavor

Same as Example 1.

EXAMPLE 4

(a) Denitration of the Tobacco

Same as Example 2.

(b) Metabolic Assimilation

Same as Example 2.

(c) Recovery of Amino Acids

The biomass obtained above was dried to a moisture content of 60%. By doing so, 500 g of wet yeast were obtained. 2.5 kg of the yeast obtained were mixed with 6 l $H_3PO_4$ (85%) and hydrolyzed according to paragraph (c) of Example 4. 300 g of amino acid mixture could thereby be obtained, the composition of which is specified in Table 4.

(d) Recovery of the Flavor

Same as Example 1.

EXAMPLE 5

Same as Example 4 with the only difference that the recovery of amino acids was performed through the hydrolysis of 1.2 kg of yeast with a moisture content of 70% and that 120 g of amino acid mixture were recovered.

EXAMPLE 6

Same as Example 3 with the exception that 5 l of KOH (6 N) were used in lieu of $H_3PO_4$ in the recovery of the amino acids. The pH value of this solution was adjusted to 1.1 by the use of HCl prior to addition of the ion exchanger. 280 g of an amino acid mixture could be recovered, the composition of which is shown in Table 4.

EXAMPLE 7

(a) Deproteinization and Denitration of the Tobacco

Same as Example 1.

(b) Metabolic Assimilation

Same as Example 1.

(c) Recovery of Amino Acids

Same as Example 1.

(d) Recovery of the Flavor 332 g of an amino acid mixture obtained according to paragraph (c) were mixed with 252 g of xylose and 510 ml of deionized water. The pH was then adjusted to 7.0 by the use of a 25% ammonium hydroxide solution. The reaction mixture was then refluxed at 90° C. for 140 hours. The resulting brown product solution was filtered and the filtrate was sprayed onto reconstituted tobacco in quantities of up to 20%.

EXAMPLE 8

(a) Deproteinization and Denitration of the Tobacco

Same as Example 1.

(b) Metabolic Assimilation

Same as Example 1.

(c) Recovery of Amino Acids

Same as Example 1.

(d) Recovery of the Flavor 219 g of an amino acid mixture obtained according to paragraph (c) were mixed with 120 g of glucose and 435 ml of deionized water. The pH was then adjusted to 6.8 by the use of a 25% ammonium hydroxide solution. The reaction mixture was then kept under pressure at 105° C. for 25 hours. The resulting brown product solution was filtered and the filtrate sprayed onto poor Burley tobacco in quantities of 20%.

EXAMPLE 9

(a) Denitration of the Tobacco

Same as Example 2.

(b) Metabolic Assimilation

Same as Example 2.

(c) Recovery of Amino Acids

Same as Example 2.

(d) Recovery of the Flavor 180 g of an amino acid mixture obtained according to paragraph (c) were mixed with 76 g of glucose and 400 ml of deionized water. The reaction mixture was then refluxed at 90° C. for 120 hours. The resulting brown product solution was filtered and the filtrate sprayed onto extracted tobacco strips in quantities of up to 40%.

EXAMPLE 10

(a) Denitration of the Tobacco
Same as Example 2.
(b) Metabolic Assimilation
Same as Example 2.
(c) Recovery of Amino Acids
Same as Example 3.
(d) Recovery of the Flavor
217 g of an amino acid mixture obtained according to paragraph (c) were mixed with 91 g of glucose and 480 ml of deionized water. The reaction mixture was then kept under pressure at 110° C. for 120 hours. The resulting brown product solution was filtered and the filtrate was sprayed onto extracted tobacco ribs in quantities of up to 80%.

EXAMPLE 11

(a) Denitration of the Tobacco
Same as Example 2.
(b) Metabolic Assimilation
Same as Example 2.
(c) Recovery of Amino Acids
Same as Example 4.
(d) Recovery of the Flavor
Same as Example 10, except that a temperature of 180° C. was used.

EXAMPLE 12

(a) Deproteinization and Denitration of the Tobacco
Same as Example 1.
(b) Metabolic Assimilation
Same as Example 2.
(c) Recovery of Amino Acids
Same as Example 5.
(d) Recovery of the Flavor
Same as Example 8, except that the pH value was adjusted to 11.5.

EXAMPLE 13

(a) Deproteinization and Denitration of the Tobacco
Same as Example 1.
(b) Metabolic Assimilation
Same as Example 2.
(c) Recovery of Amino Acids
Same as Example 6.
(d) Recovery of the Flavor
Same as Example 8, except that the reaction was performed for 1 hour and the filtrate was added to reconstituted tobacco in quantities of 15%.

EXAMPLE 14

Same as Example 9, except that 350 g of glucose were used.

EXAMPLE 15

Same as Example 9, except that the reaction was performed at 50° C. for 200 hours.

Modifications of the examples are possible as specified hereafter: In lieu of the enzyme used in Example 1, any other enzyme specified in Table 1 may be used. In lieu of the glucose, an equimolar quantity of fructose, galactose or the like may be used. In lieu of the Candida utilis NCYC 707, one of the following Candida yeasts may be used: Candida berthetii CBS 5452, Candida utilis NCYC 321, and Candida utilis DSM 70167.

The specified cultures are availabe at the culture collections indicated by the abbreviations and can be obtained under the number specified:
NCYC: National Collection of Yeast Cultures, Brewing Industry Research Foundation
CBS: Central Bureau of Mold Cultures
DSM: German Collection of Microorganisms.

TABLE 1

| Selection of Suitable Enzymes | |
|---|---|
| Protease | EC 3.4.4.16* |
| Protease | EC 3.4.24.4 |
| Pronase | Enzyme mixture from *Streptomyces griseus* |
| Proteinase | EC 3.4.21.14 |
| Trypsin | EC 3.4.21.4 |
| Pepsin | EC 3.4.23.1 |

*EC = Enzyme Commission

TABLE 2

| | Analytical Results | |
|---|---|---|
| | Tobacco mixture (American Blend) before treatment as in Example 1 | Tobacco treated according to Example 1 |
| (a) Tobacco Analysis: | | |
| Total alkaloids %* | 1.96 | 1.76 |
| Reducing % substances | 6.7 | 3.9 |
| Nitrate-N % | 0.25 | 0.03 |
| Ammonia-N % | 0.31 | 0.05 |
| Total-N % | 3.22 | 1.63 |
| (b) Analysis of the Main Flow of Smoke: | | |
| CO mg/cig** | 16.1 | 9.1 |
| NO mg/cig | 0.31 | 0.03 |
| TPM mg/cig | 19.1 | 12.5 |
| Nicotine mg/cig | 1.31 | 1.05 |
| HCN mg/cig | 0.243 | 0.030 |
| Aldehydes mg/cig | 1.41 | 1.29 |

*Percent by dry weight
**mg/cig = Milligrams per cigarette

TABLE 3

| | Analytical Results | | |
|---|---|---|---|
| | Tobacco mixture (American Blend) before treatment as in Example 1 | Treated tobacco, i.e. the squeezed strips | Aqueous Solution |
| Total-N %* | 2.95 | 0.99 | 0.139 |
| Ammonia-N % | 0.22 | 0.02 | 0.012 |
| Nitrate-N % | 0.22 | 0.02 | 0.017 |
| Alkaloid-N % | 0.33 | 0.03 | 0.025 |
| Protein-N % | 2.18 | 0.92 | 0.085 |
| Protein | 13.62 | 5.70 | 0.53 |
| Total of % dissolved substances | — | — | 1.61 |

*% = Percent by dry weight

TABLE 4

| | Hydrolysis | | |
|---|---|---|---|
| Amino Acids | Hydrochloric Acid (Example 1) | Phosphoric Acid (Exs. 3, 4 and 5) | Potassium Hydroxide (Example 6) |
| Asparaginic acid | 9.9% | 14.7% | 7.5% |
| Glutamic acid | 16.0% | 9.4% | 17.9% |
| Lysine | 6.5% | 6.9% | 1.4% |
| Histidine | 1.8% | 2.0% | 5.1% |
| Arginine | 5.0% | 7.1% | 0.6% |
| Threonine | 5.5% | 4.5% | 0.3% |
| Serine | 4.8% | 3.1% | 1.2% |
| Proline | 4.6% | 4.6% | 6.7% |
| Glycine | 5.4% | 5.7% | 7.6% |
| Alanine | 6.9% | 8.5% | 16.3% |

TABLE 4-continued

| Amino Acids | Hydrolysis: Hydrochloric Acid (Example 1) | Phosphoric Acid (Exs. 3, 4 and 5) | Potassium Hydroxide (Example 6) |
|---|---|---|---|
| Cysteine | —* | — | 1.0% |
| Valine | 6.5% | 4.1% | 6.0% |
| Methionine | 1.3% | 1.3% | 1.9% |
| Isoleucine | 5.1% | 3.2% | 2.5% |
| Leucine | 6.8% | 6.3% | 9.6% |
| Tryosine | 1.9% | 3.0% | 5.2% |
| Phenylalanine | 4.1% | 3.5% | 4.4% |
| Tryptophane | — | — | — |
| Total Amino Acids | 92.0% | 88.0% | 95.0% |

*Not detectable, less than 0.01%.

We claim:

1. A method for treating tobacco to produce flavors comprising the steps of:

(a) hydrolytically degrading into an amino acid mixture the proteins of biomass produced by the assimilation of low-molecular weight nitrogen compounds from an aqueous tobacco extract, with tryptophane being destroyed in the process to less than 0.01 percent by weight of said amino acid mixture; and (b) converting the amino acid mixture into flavors, in the course of the Maillard reaction, by treating said mixture with reducing sugars and heat under continuous stirring, at a pH value of 3–12, for 1–200 hours, at a temperature of 20°–180° C., with a molar ratio of the amino acid mixture to the reducing sugar added between 4:1 and 1:4 in aqueous solution, with a solids content of 20–70 percent by weight and at a pressure of 1–5 atmospheres.

2. The method of claim 1 wherein any insoluble residual matter in the hydrolyzed biomass is separated from the amino acid mixture before said mixture is treated with the reducing sugars and heat.

3. The method of claim 1 wherein the amino acid mixture is isolated by chromatographic adsorption and subsequent evaporation to dryness before said mixture is treated with the reducing sugars and heat.

4. The method of claim 1 further comprising the step of applying the flavors obtained in step (b) to tobacco.

5. The method according to claim 5 wherein the tobacco material is reconstituted tobacco.

6. The method of claim 4 wherein the flavors are sprayed onto tobacco in quantities of 0.05 to 0.8 milliliters per gram of tobacco material.

7. A tobacco material comprising tobacco contacted with a flavor produced by the process of claim 1.

8. The method of claim 1 wherein step (b) is performed under continuous stirring, at a pH value of 6–7, for 70–140 hours, at a temperature of 90°–140° C., with a molar ratio of amino acid mixture to the reducing sugar added between 1:1 and 2:1 in aqueous solution, with a solids content of 45–55 percent by weight and at a pressure of 1 atmosphere.

9. The method of claim 1 further comprising the step of extracting from the flavors obtained in step (b) the components essential to a desired flavor.

10. The method of claim 1 wherein assimilation of said nitrogen compounds is performed by microorganisms capable of metabolically assimilating nitrogen.

11. The method of claim 10 wherein the microorganisms are Candida yeasts.

12. The method of claim 11 wherein the Candida yeasts are selected from the group consisting of Candida utilis NCYC 707, Candida berthetii CBS 5452, Candida utilis NCYC 321 and Candida utilis DSM 70167.

13. The method of claim 12 wherein step (a) is performed under continuous stirring, at a temperature of 50°–130° C., for 2–300 hours, with a yeast solids content of 5–50 percent by weight, an acid concentration of 0.5–45 normal and at a pressure of 1–3 atmospheres.

14. The method of claim 13 wherein step (a) is performed at a temperature of 90° C., for 110 hours with a yeast solids content of 20 percent by weight and at a pressure of 1 atmosphere.

15. The method of claim 1 wherein during assimilation of said nitrogen compounds, the aqueous tobacco extract is enriched by the use of a carbon source to a concentration of $16.5 \pm 10$ assimilative carbon atoms per nitrate molecule and by necessary nutrients other than nitrogen while being aerated at a rate of 0.5 to 2.5 $l \times l^{-1} \times min^{-1}$ and maintained at a pH value between 3.5 and 6 and at a temperature between 25° C. and 37° C.

16. The method of claim 15 wherein the aqueous tobacco extract is aerated at a rate of 1.4 to 1.6 $l \times l^{-1} \times min^{-1}$ and maintained at a pH of $5.5 \pm 0.3$ and at a temperature of 30° C. ±3° C.

* * * * *

UNITED STATES PATENT AND TRADEMARK OFFICE

CERTIFICATE OF CORRECTION

PATENT NO. : 4,537,204

DATED : August 27, 1985

INVENTOR(S) : Helmut Gaisch et al

It is certified that error appears in the above-identified patent and that said Letters Patent is hereby corrected as shown below:

Column 4, line 55, "obtaind" should read -- obtained --.

Column 8, line 1, "availabe" should read -- available --.

Column 9, line 47, "claim 5" should be -- claim 4 --.

Signed and Sealed this

Twenty-seventh Day of October, 1987

*Attest:*

DONALD J. QUIGG

*Attesting Officer*

*Commissioner of Patents and Trademarks*